United States Patent [19]

Busch

[11] 4,071,060

[45] Jan. 31, 1978

[54] CROSSTIE ADZING AND BORING MACHINE

[76] Inventor: Glen D. Busch, P.O. Box 29, Mena, Ark. 71953

[21] Appl. No.: 659,888

[22] Filed: Feb. 20, 1976

[51] Int. Cl.[2] ..... B27C 9/04

[52] U.S. Cl. ..... 144/3 H; 144/92; 144/133 A; 144/309 R; 144/321; 144/326 R; 408/24

[58] Field of Search ..... 144/1 R, 2 R, 3 R, 3 H, 144/114 R, 117 R, 134 R, 134 B, 136 R, 92, 309 R, 321, 323, 326 R, 133 R, 133 A, 133 B, 120, 128, 203, 325; 408/22, 24

[56] References Cited

U.S. PATENT DOCUMENTS

| | | | |
|---|---|---|---|
| 1,195,852 | 8/1916 | Purdy et al. | 144/3 H |
| 1,686,915 | 10/1928 | Lane | 144/3 H |
| 2,593,744 | 4/1952 | Gillespie | 144/3 R X |
| 3,263,718 | 8/1966 | Carmichael et al. | 144/314 R X |

FOREIGN PATENT DOCUMENTS

| | | | |
|---|---|---|---|
| 721,652 | 3/1932 | France | 144/3 H |

*Primary Examiner*—Travis S. McGehee
*Assistant Examiner*—W. D. Bray
*Attorney, Agent, or Firm*—Robert K. Rhea

[57] ABSTRACT

An upright main frame is provided with horizontal rails extending transversely through the frame to form a travel path for crossties. A pair of motor driven adzing heads are supported below the crosstie travel path for forming rail seats on the depending surface of the crosstie as it moves through the machine. A boring tool frame, including longitudinal horizontally disposed beams, supporting a plurality of motor driven boring tools, is vertically movable within the frame for forming rail spike pilot holes in the crossties. A carriage frame is horizontally supported by the main frame for to and fro reciprocating movement below the plane defined by the upper limit of the crosstie supporting rails. Dogs, pivotally secured to the carriage frame, move the crossties along the travel path in a step-by-step fashion by the carriage frame movement. A motor driven sequence control shaft, extends longitudinally through the main frame and is connected by an eccentric and pitman arm with vertically reciprocable main frame end panels connected with the boring tool support beams for raising and lowering the boring tools. Cams, secured to the control shaft, engage cam plates secured to carriage frame movement control tubes, to reciprocate the carriage frame in unison with the boring tool action on the crossties.

7 Claims, 7 Drawing Figures

10
12
14
16
18
20
22
24
26
30
32
34
36
38
40
42
44
46
48
52
54
56
58
60
63
66
72
74
76
78
82
84
86
88
90
92
96
98
102
108
110
112
114
118
136
144
150
152
154
157
160
162
164
166
168
174
176

CROSSTIE ADZING AND BORING MACHINE

BACKGROUND OF THE INVENTION

1. Field of the Invention

The present invention relates to a combined adzing and boring machine and more particularly to a machine which successively moves a plurality of crossties along a travel path through the machine for leveling the rail plate supporting surfaces and boring rail spike pilot holes in the crossties.

Railway crossties are usually provided on the surface to be disposed upwardly with recesses for receiving rail plates which in turn support and secure the rails to the crosstie by railroad spikes being driven through pilot holes formed in the rail plates and into the crosstie. Since crossties are usually formed of hard wood, such as oak, it is customary to drill pilot holes in the crosstie for receiving the rail spikes for accuracy and ease in driving the spikes.

2. Description of the Prior Art

Prior art patents generally disclose relatively complicated and expensive apparatus for adzing and boring railroad crossties which require clamping jaws or gripping members for holding the crosstie in position while being acted on from its depending surface, such as U.S. Pat. Nos. 582,915 and 1,704,273. Other patents, such as U.S. Pat. Nos. 1,161,986 and 1,210,908, require tracks for moving the machine relative to the crosstie rather than moving the crossties through the machine.

This invention provides a relatively simple and economical open-type framework which progressively moves crossties along a travel path through the machine which does not require clamp means for supporting the crosstie when acted on by the machine.

SUMMARY OF THE INVENTION

An upright open-type main frame supports a plurality of rails extending transversely through the frame intermediate its height to form a travel path for crossties moved toward and away from the frame by conveyor means. A carriage frame is horizontally supported by the main frame below the travel path and provided with pivoting dogs for engaging and progressively moving the crossties in step-by-step fashion along the travel path. Motor driven adzing heads are adjustably supported by the frame and intersect the lower limit of the travel path for cutting transverse recesses in the depending surface of crossties moved along the travel path. Longitudinally extending beams, forming a part of a boring tool frame, are horizontally supported within the frame and are connected at their respective ends with vertically reciprocable frame end panels supported by the main frame ends. Motor driven boring tools, supported by the beams, and cooperatively aligned with the adzing heads, are moved toward and away from a crosstie for boring holes therein when moved into position by the carriage frame. A motor driven control shaft extending longitudinally through and journalled by the frame is connected by eccentric and pitman arm means with the end panels for vertically reciprocating the boring tools. Camming means, secured to the control shaft, engage cam surfaces formed on a carriage frame movement control tube for reciprocating the carriage frame and successively moving crossties along the travel path.

The principal object of this invention is to provide an economical adzing and boring machine for crossties which, progressively move the crossties automatically along a travel path extending transversely through the machine for forming rail seats and rail spike pilot holes in the crossties as the crossties are delivered to the machine from a feeding conveyor and discharged to a stock pile location by a disposal conveyor.

DESCRIPTION OF THE PREFERRED EMBODIMENT

Figure 1:
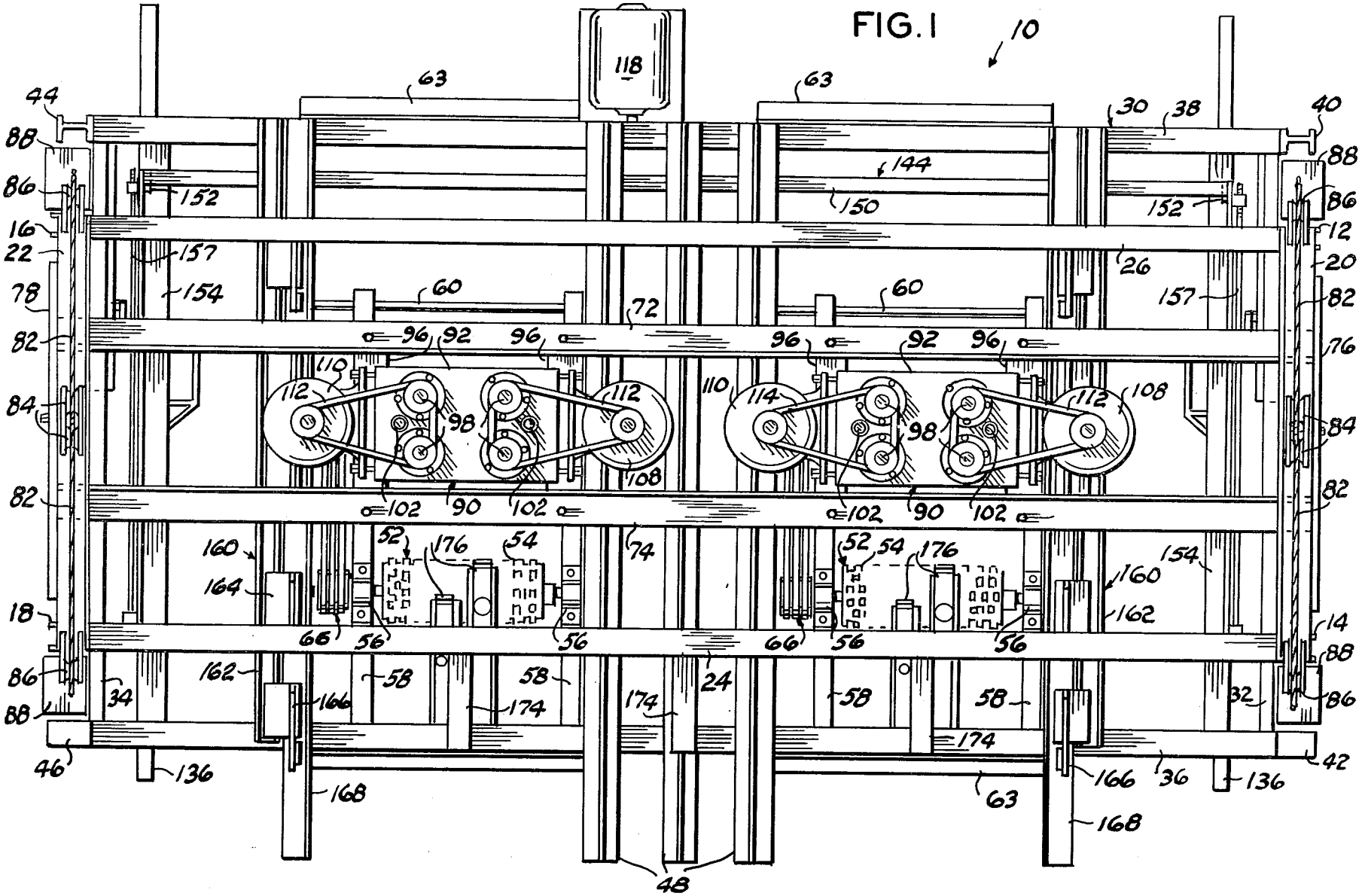
FIG. 1 is a top view of the machine.
Figure 2:
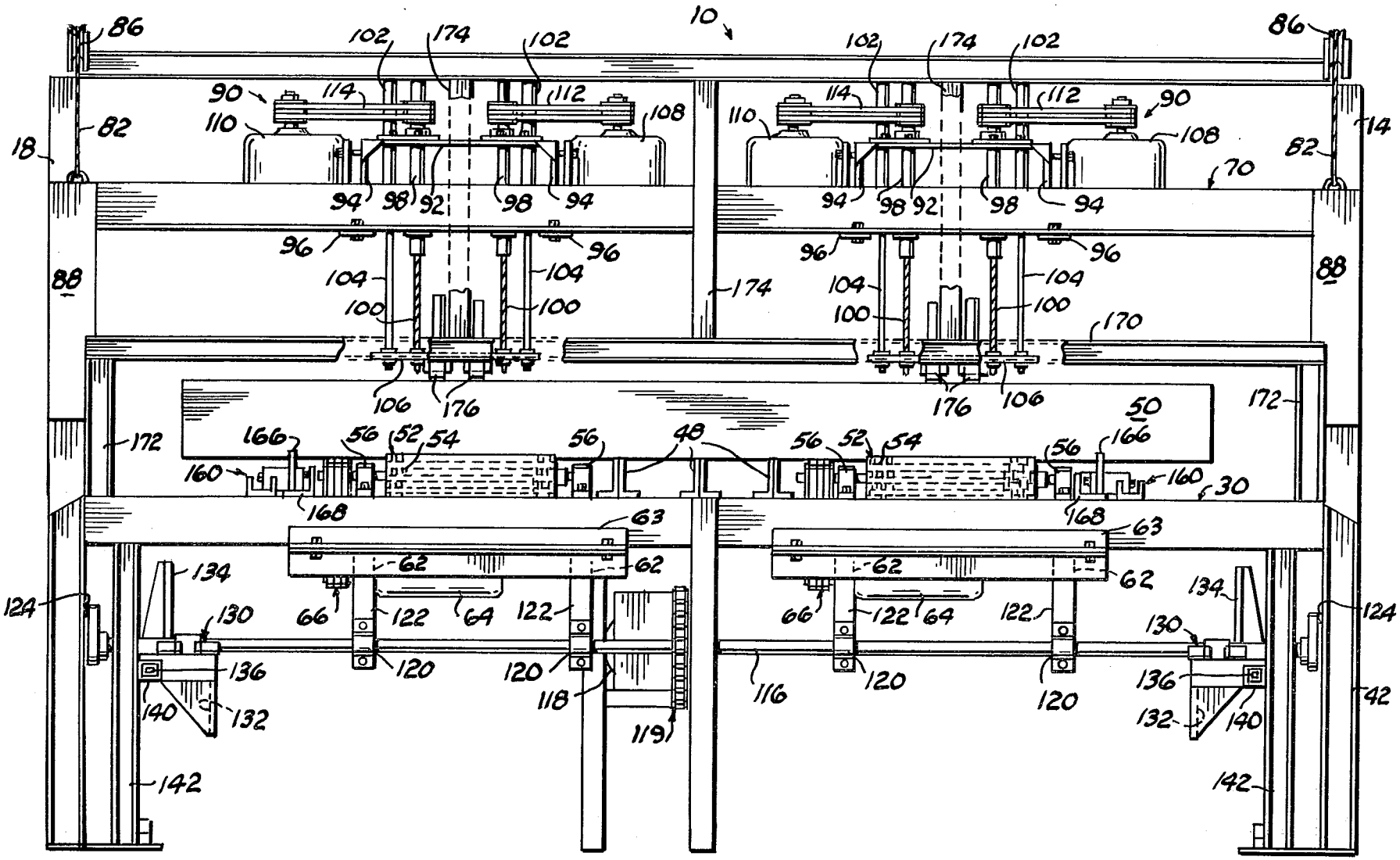
FIG. 2 is a front elevational view of FIG. 1 with parts broken away for clarity and illustrating a crosstie in the travel path.

Like characters of reference designate like parts in those figures of the drawings in which they occur.

In the drawings:

The reference numeral 10 indicates a generally rectangular upright main frame formed by vertically disposed corner posts 12, 14, 16 and 18 mounted on a suitable base and interconnected at their upper ends by end members 20 and 22, respectively, and longitudinally extending side members 24 and 26. A workpiece support frame 30 transversely intersects the main frame 10 intermediate its height and is formed by horizontal end members 32 and 34 extending laterally beyond the respective sides of the main frame and respectively connected with the main frame corner posts 12–14 and 16–18. The end members 32 and 34 are interconnected by a frame front longitudinal channel member 36 and a rear channel member 38. The workpiece support frame 30 is supported laterally of the main frame 10 by stub corner posts 40–42 and 44–46. A plurality of workpiece support tracks 48, each inverted T-shaped in end elevation, extend forwardly of the front member 36 and transversely between the workpiece frame members 36 and 38, intermediate their ends, in overlying relation and form a horizontal travel path, transversely of the main frame, for a workpiece, such as a crosstie 50, or the like.

A pair of adzing means 52 is supported by the workpiece support frame 30 in spaced relation longitudinally of the main frame. Each adzing means 52 comprises a generally cylindrical cutting tooth equipped cutter 54 having an axle journalled by bearings 56 mounted on support rails 58 pivotally connected by bearings, not shown, to a horizontal shaft 60 supported by subframe members 62 extending transversely of the workpiece frame 30 is spaced parallel relation and secured to the workpiece frame members 36 and 38 by brackets 63 so that each cutter 54 may be moved vertically about the axis of the shaft 60 to adjust the cutting depth of the cutter 54.

The support rails 58 support a motor 64 in depending relation which is drivably connected with the respective cutter 54 by belt and pulley means 66.

Figure 3:
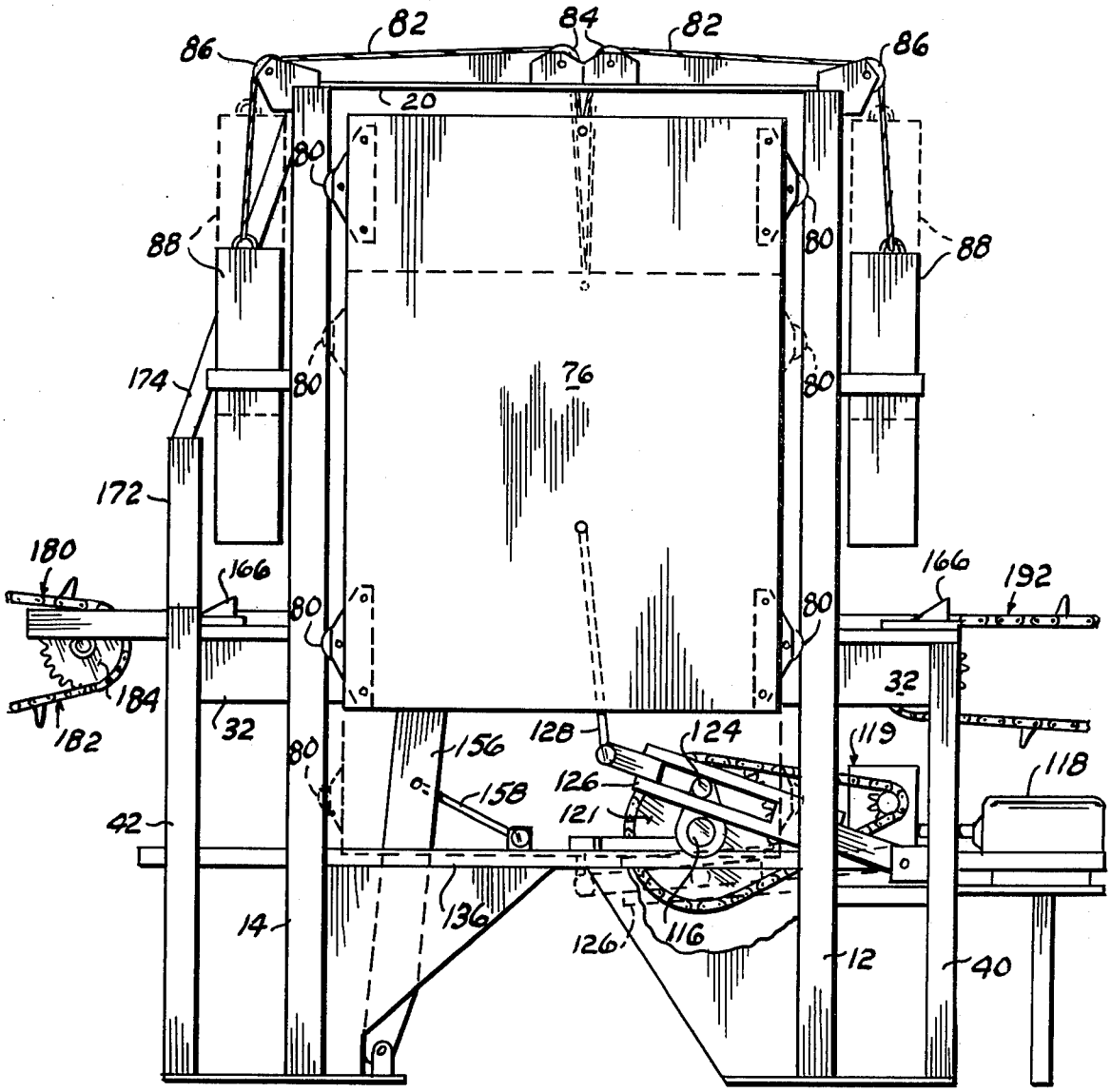
FIG. 3 is a right end elevational view of FIG. 2 illustrating, by dotted lines, vertical movement of the frame end panels.

A boring tool frame 70 is supported by the main frame for vertical reciprocation therein. The boring tool frame 70 includes a pair of angle iron beams 72 and 74 extending horizontally between the ends of the main frame 10 in laterally spaced parallel relation and are connected at their respective ends with main frame end panels 76 and 78 intermediate the height of the latter. The end panels 76 and 78 are generally rectangular and are respectively disposed between the main frame posts 12–14 and 16–18. The respective vertical side edges of each end panel is provided with a plurality of rollers 80, four in the example shown (FIG. 3), which travel on vertical tracks formed on confronting faces of the respective main frame posts. The upper end portion of each end panel 76 and 78 is connected by flexible members, such as cables 82, entrained over frame end supported pulleys 84 and 86, with counterweights 88 for counterbalancing the boring tool frame 70. A pair of boring tool means 90 is mounted on the beams 72 and 74 in spaced relation longitudinally of the beams and in cooperative alignment, transversely of the main frame, with the adzing means 52. Each of the boring tool means 90 comprises a substantially U-shaped bracket 92 having its bight portion horizontally disposed upwardly and its depending legs 94 resting on and supported by a pair of supports 96 extending between and secured to the depending surface of the beams 72 and 74. The bight portion of the bracket 92 is provided with a plurality of apertures, not shown, receiving a selected number of boring tool holders 98, forming a set of four in the example shown, each connected at its depending end with a boring tool or bit 100. Other apertures in the bight portion of the bracket 92 support guide tubes 102, two in the example shown, which telescopically receive guide rods 104 slidably connected with a horizontally disposed boring tool guide plate 106 at their depending ends for maintaining the selected spaced relation of the bits 100.

Two pairs of motors 108 and 110, one pair for each boring tool holder sets 98, are respectively supported by the legs 94 of the bracket 92 and connected with the boring bit holder sets 98 by belt and pulley means 112 and 114.

Figure 4:
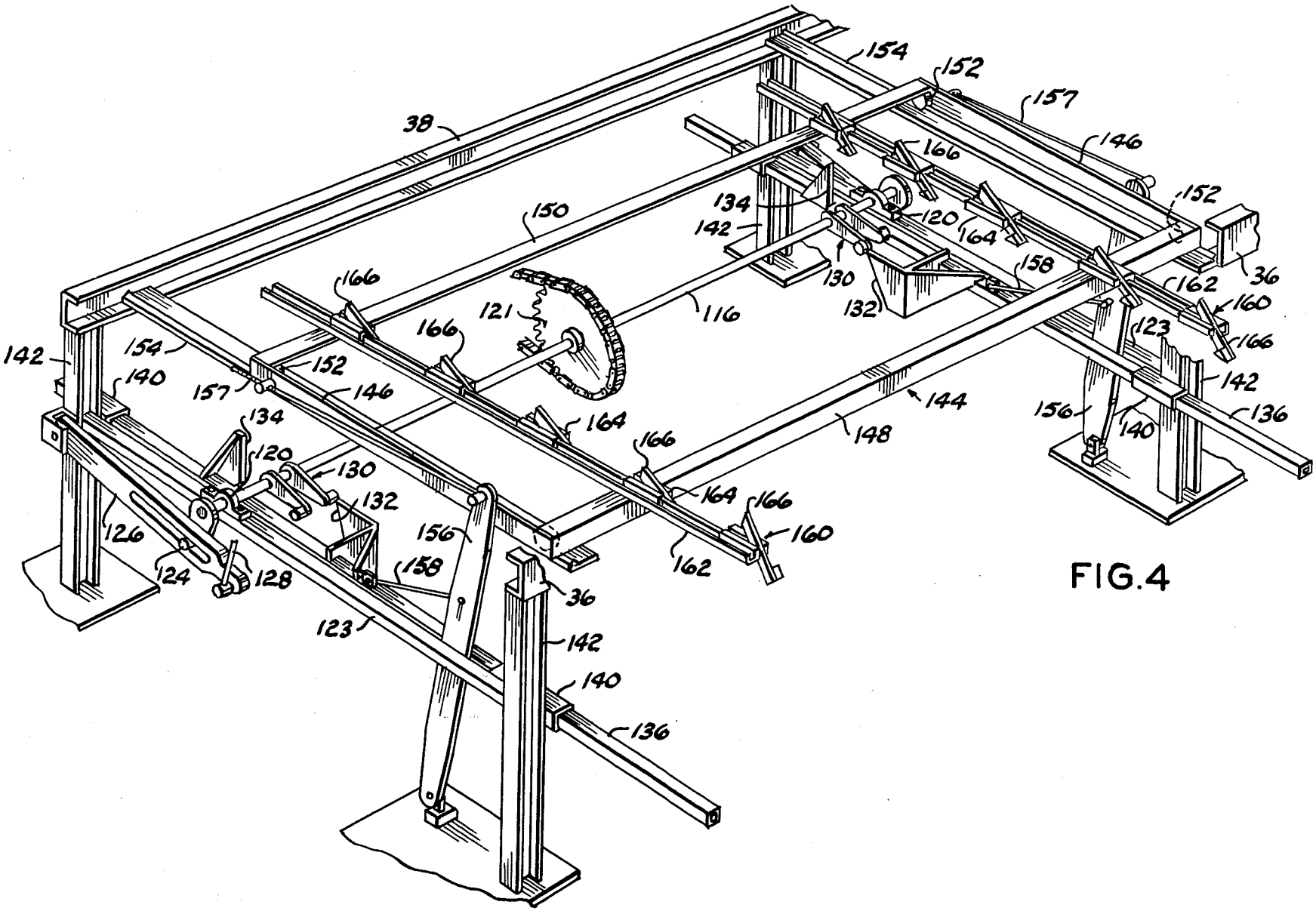
FIG. 4 is a fragmentary perspective view of the carriage frame control shaft and components.
Figure 5:
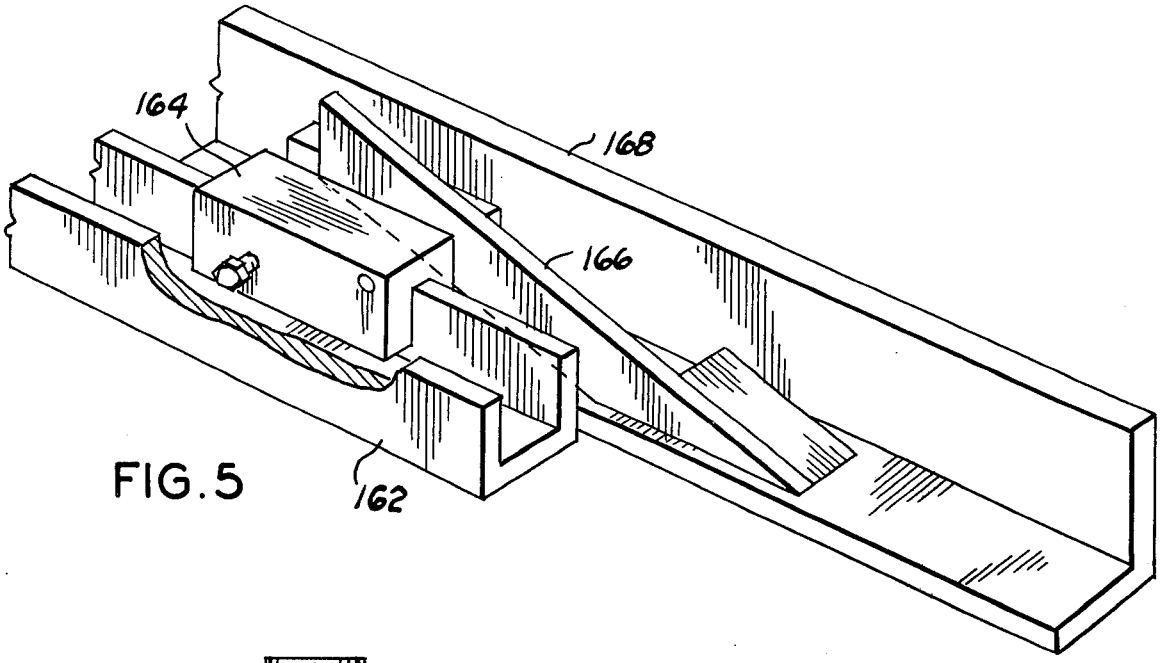
FIG. 5 is a fragmentary perspective view of the components for moving the crosstie.
Figure 6:
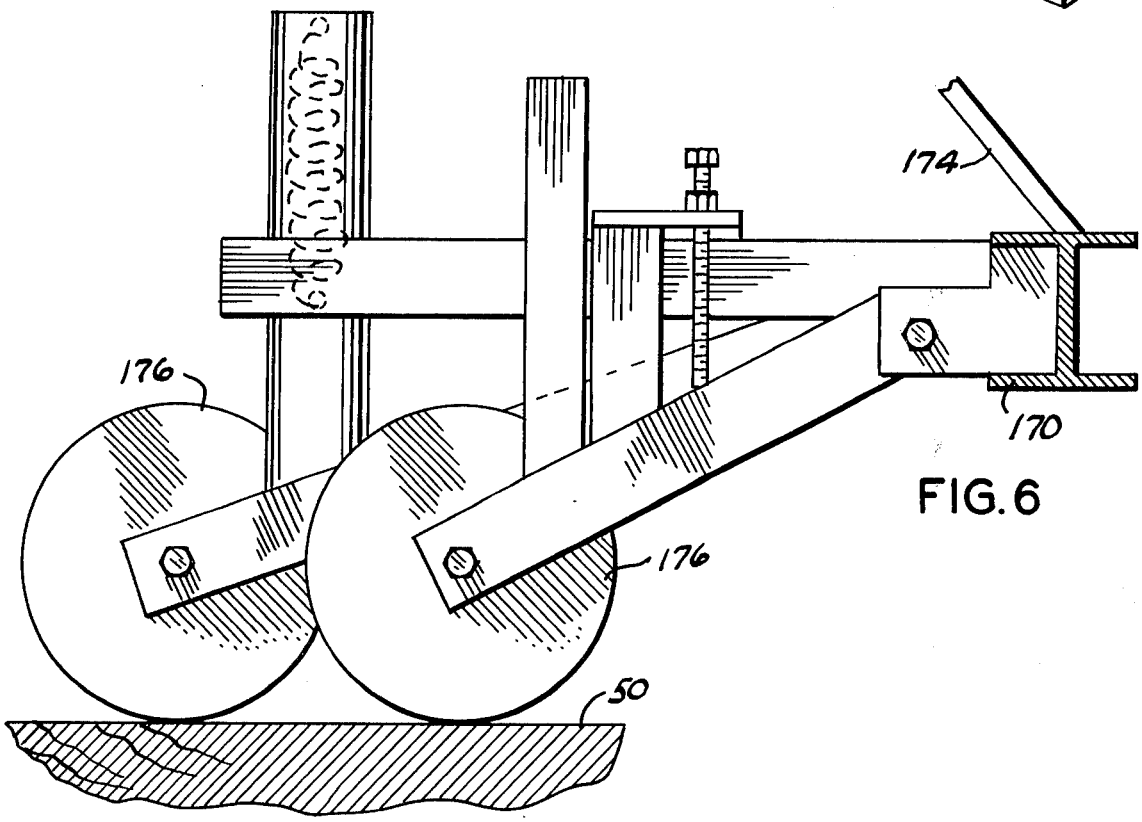
FIG. 6 is a side elevational view, partly in cross section of the crosstie holddown rollers; and, FIG. 7 is a perspective view of a crosstie after being adzed and bored.

A control shaft 116, driven by a motor 118 and transmission means 119 including a sprocket 121 on the shaft, extends longitudinally of the main frame below the workpiece support frame 30 and is journalled, intermediate its ends, by bearings 120 connected with legs 122 connected in depending relation with the cutter means support rails 62 and by shaft support bars 123 extending between frame supports (FIG. 4).

A bearing shaft 124 is eccentrically mounted on the respective end of the control shaft 116 and reciprocates in a suitable slot formed in a pitman arm 126 pivotally connected, at one end, with the main frame stub posts 40 and 44, respectively, and pivotally connected, at its other end, by a rod 128 with the respective end panel 76 and 78 so that rotation of the control shaft 116 vertically reciprocate the end panels 76 and 78 and beams 72 and 74 supporting the boring tool means 90.

Cam means 130, comprising laterally projecting cam arms secured to the control shaft 116 adjacent its respective ends, successively engage cam plates 132 and 134 secured in spaced relation transversely of the main frame to a horizontal carriage frame movement control tube 136 slidably supported by sleeves 140 in turn connected with frame lateral support stub legs 142 at the respective corner portions of the main frame for longitudinally reciprocating the control tube 136.

A horizontally disposed carriage frame 144 is disposed below the workpiece travel path within the work support frame 30. The carriage frame 144 includes end members 146 extending transversely of the work frame 30 and connected with longitudinal side members 148 and 150. The carriage frame 144 is supported by rollers 152 secured within its respective corners and supported by tracks 154 extending between and connected with the respective end portions of the workpiece frame members 36 and 38. A pair of elongated upstanding carrier frame control arms 156, pivotally connected at their depending ends with the main frame base, are pivotally connected, by rods 157, with the respective carrier frame end member 146. Each carrier frame control arm is connected with the respective control tube 136 by a rod 158. At least two workpiece moving means or carriers 160 are supported by and movable with the carriage frame 144. Each of the carrier means 160 comprises a U-shaped channel 162, having its legs disposed upwardly, and extending beyond and connected with the carrier frame side members 148 and 150, are movable therewith in a horizontal plane spaced slightly above the horizontal plane defined by the workpiece frame members 36 and 38. The carriers 160 further include a plurality of substantially rectangular blocks 164 connected, in longitudinally spaced relation, with one leg of the channel 162 and includes a pivotally connected elongated barlike dog 166 having one end portion projecting upwardly above the horizontal upper limit of each block 164 and intersecting the horizontal plane of the lower limit of the workpiece travel path. The dogs 166 are counterbalanced to normally maintain the said one end upward and are slidably supported, at their depending end by an angle iron carrier guide 168 extending transversely through the frame, coextensive with the rails 48 and forming additional crosstie supporting rails which are similarly connected with the upper limit of the workpiece frame members 36 and 38. The carrier dogs 166 are cooperatively aligned by pairs transversely of the travel path.

A longitudinally extending pressure support rail 170 is horizontally supported in spaced relation above the forward work frame member 36 by standards 172 disposed at the respective end portion of the member 36. The support rail 170 is braced, intermediate its ends, against upward movement by brace members 174 extending between the support rail 170 and top rail 24 of the main frame. The support rail 170 supports two pairs of wheels or rollers 176 pivotally connected with the support rail 170 above the position of the adzing cutters 54 and are spring biased downwardly for rolling pressure with the upper surface of the crosstie 50 as it is moved by the carriage frame 144 across the position of the adzing means 52.

OPERATION

Figure 7:
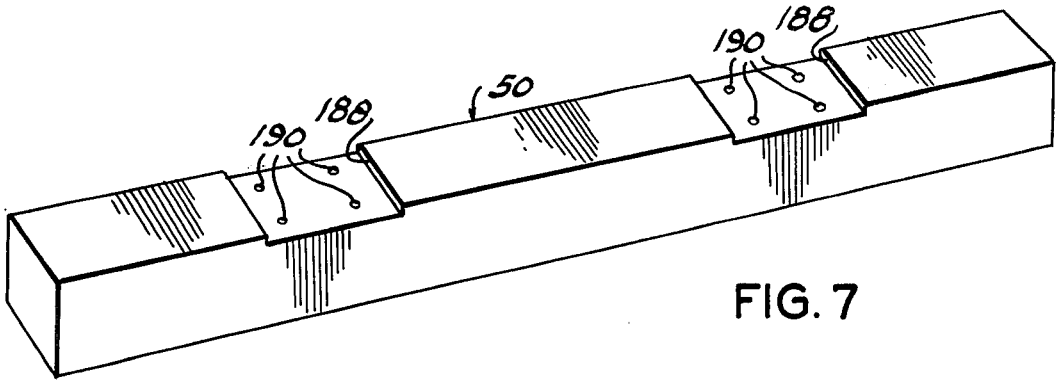

For simplicity the operation on a single crosstie will be described. A supply conveyor 180, comprising a lug equipped chain 182 entrained around sprockets 184, one being shown, progressively moves the crosstie 50 to be adzed and bored by the machine 10 into the entrance end of the travel path. The carriage frame 144 is moved toward the front of the machine by the carrier frame arm 156 in response to the camming means 130 rotating with the motor driven control shaft 116 and contacting the cam surface 132 and moving the control tubes 136 forwardly. After the camming means 130 moves out of contact with the cam surface 132 the carriage frame 144 remains stationary until the camming means 130, by rotating substantially 180° about the axis of the control shaft 116, contacts the cam surface 134 to move the carriage frame 144 toward the exit end of the travel path. The pair of forwardmost dogs 166 then engage the crosstie 50 and moves it along the travel path. As the crosstie passes the position of the adzing cutters 54, the pressure rollers 176, contacting its upper surface, maintains the crosstie in contact with the support rails 48 so that the cutters form a recess or notch 188 (FIG. 7) of predetermined depth in the depending surface of the crosstie. The camming means 130, having been rotated out of contact with the cam surface 134, permits the carriage frame 144 to remain stationary disposing the crosstie 50 in vertical alignment below the boring tool means 90. The eccentric 124, by pivoting the pitman arm 126 downwardly, moves the end panels 76 and 78 downwardly, to their dotted line position (FIG. 3), and lowers the boring tool means 90 into contact with the crosstie 50 thus boring a plurality of rail spike pilot holes 190 in the crosstie. Continued rotation of the eccentric 124 elevates the end panels 76 and 78 to their solid line position (FIG. 3) and lifts the boring tool means 90 out of contact with the crosstie while simultaneously the camming means 130, by again contacting the cam surface 132, moves the carriage frame 144 toward the entrance end of the travel path. Forward movement of the carriage frame 144 and carriers 160 relative to the stationary crosstie is accomplished by the dogs 166 pivoting downwardly, at their upstanding ends, to pass under the crosstie. As the camming means 130, is again rotated into contact with the cam surface 134, other dogs 166 move the crosstie 50 another step toward the ejection end of the travel path. The carriage frame and its dogs 166 eject the crosstie from the frame travel path to a similar disposal conveyor means 192 which deposits the crosstie at a selected location. The cutters 154 may be lowered relative to the travel path to eliminate recessing the crosstie and the spacing between the boring tools 100 adjusted as required or one or more of the boring tools may be omitted.

Obviously the invention is susceptible to changes or alterations without defeating its practicability. Therefore, I do not wish to be confined to the preferred embodiment shown in the drawings and described herein.

I claim:

1. A railroad crosstie adzing and boring machine, comprising:

a rectangular open type main frame;

rack means extending transversely through said main frame and forming a horizontal travel path for crossties;

adzing means supported by said main frame adjacent the travel path for acting on crossties moved through said main frame;

reciprocable carriage means disposed transversely within said main frame below the travel path for engaging and moving crossties along the travel path in step-by-step fashion;

boring tool means supported by said main frame for vertical movement toward and away from crossties within the travel path; and, control means including cam means and an eccentric mounted on a control shaft extending longitudinally of said main frame below said carriage means for respectively reciprocating said carriage means horizontally and vertically reciprocating said boring tool means toward and away from a crosstie in the travel path in unison with crosstie movement along the travel path.

2. The adzing and boring machine according to claim 1 in which said rack means comprises:

a workpiece support frame including spaced-apart frame members longitudinally supported by said main frame; and, a plurality of tracks extending between and supported by said frame members in overlying relation.

3. The adzing and boring machine according to claim 1 in which said adzing means includes:

motor driven cutters disposed transversely of the direction of crosstie movement along the travel path.

4. The adzing and boring machine according to claim 1 in which said carriage means includes:

a carriage frame supported by said workpiece support frame for to and fro movement in the direction of crosstie travel along the travel path;

a plurality of carriers connected with said carriage frame in longitudinal spaced relation in the direction of crosstie movement; and, a like plurality of dogs pivotally connected with said carriers and each having an end portion normally intersecting the lower limit of the horizontal travel path for engagement with crossties disposed in the travel path.

5. The adzing and boring machine according to claim 1 in which said boring tool means includes:

a boring tool frame vertically reciprocably supported by said main frame, said boring tool frame including end panels disposed at the respective ends of said main frame and at least one beam extending longitudinally of said main frame and connected with said end panels;

motor driven boring tool holders supported by said beam in cooperative alignment with said adzing means; and, a boring bit secured to each said boring tool holder.

6. The adzing and boring machine according to claim 5 in which said control means includes:

a motor driving said control shaft;

a pair of pitman arms pivotally connected at one end with said main frame and at their other ends with the respective said end panel;

an eccentric bearing shaft connecting the respective end of said control shaft with the respective said pitman arm;

cam plates having cam surfaces secured to said carriage means below the travel path; and, cam arm means engaging said cam surfaces during angular rotation of said control shaft for reciprocating said carriage means.

7. A railroad crosstie adzing and boring machine, comprising:

a rectangular main frame having a vertically disposed vertically reciprocable end panel at its respective ends;

horizontal crosstie supporting tracks extending transversely through said main frame and forming a travel path for crossties;

adzing cutters supported by said main frame transversely of the crosstie travel path;

a carriage frame reciprocably supported by said main frame for movement below and in the direction of the travel path;

carriers connected with said carriage frame and slidable on said crosstie supporting tracks;

dogs pivotally mounted on the carriers and having an end portion normally intersecting the travel path for engaging and progressively moving crossties along the travel path;

at least one beam extending longitudinally of said main frame above the crosstie travel path and connected, at its respective ends, with said end panels;

boring tools operatively supported by said beam;

a control shaft longitudinally journalled by said main frame; motors drivably connected with said adzing cutters, said boring tools and said control shaft;

a pitman arm extending between and pivotally connected with each said end panel and said main frame;

an eccentric bearing shaft connecting the respective end of said control shaft with each said pitman arm for vertically reciprocating said end panels;

cam plates having cam surfaces secured to said carriage frame; and, cam means secured to said control shaft and cooperatively engaging said cam surfaces for reciprocating said carriage frame in cooperation with vertical reciprocating movement of said boring tool and said beam.

* * * * *